US005643045A

United States Patent [19]

Kirt

[11] Patent Number: 5,643,045

[45] Date of Patent: Jul. 1, 1997

[54] RETROFIT KIT FOR DRIVING THE REGULATING WHEEL OF A CENTERLESS GRINDER

[76] Inventor: Thomas J. Kirt, 38629 Moravian Dr., Clinton Township, Macomb County, Mich. 48036

[21] Appl. No.: 434,859

[22] Filed: May 4, 1995

[51] Int. Cl.[6] ..... B24B 49/00; B24B 5/18

[52] U.S. Cl. ..... 451/5; 451/49; 451/242; 451/244

[58] Field of Search ..... 451/5, 49, 242, 451/243, 244, 246, 436, 245

[56] References Cited

U.S. PATENT DOCUMENTS

| | | | |
|---|---|---|---|
| 3,872,626 | 3/1975 | White . | |
| 4,009,538 | 3/1977 | Hanecker | 451/243 |
| 4,149,343 | 4/1979 | Feldmeier . | |
| 4,712,332 | 12/1987 | Smith | 451/244 X |
| 4,760,759 | 8/1988 | Blake . | |
| 4,951,518 | 8/1990 | Hendershot . | |

*Primary Examiner*—Timothy V. Eley
*Attorney, Agent, or Firm*—Young & Basile, P.C.

[57] ABSTRACT

A retrofit kit for the regulating wheel drive of a centerless grinder. The kit includes a controller, an electric motor controlled by the controller, a cycloidal speed reducer driven by the electric motor, a belt sprocket provided on the output shaft of the speed reducer, a further belt sprocket carried by the spindle of the regulating wheel, and a toothed belt for engagement with the belt sprockets. The retrofit kit is installed by removing a cover plate on the housing of the grinder to expose an access opening, disabling the existing regulating wheel drive system by removing idler sprockets and drive chains, mounting a new belt sprocket on the regulating wheel spindle, positioning the gear motor on the housing proximate the exposed access opening with the gear reducer extending through the opening into the interior of the housing to position the speed reducer belt sprocket within the housing, and training the toothed belt around the speed reducer sprocket and the spindle sprocket.

7 Claims, 5 Drawing Sheets

FIG-1
PRIOR ART
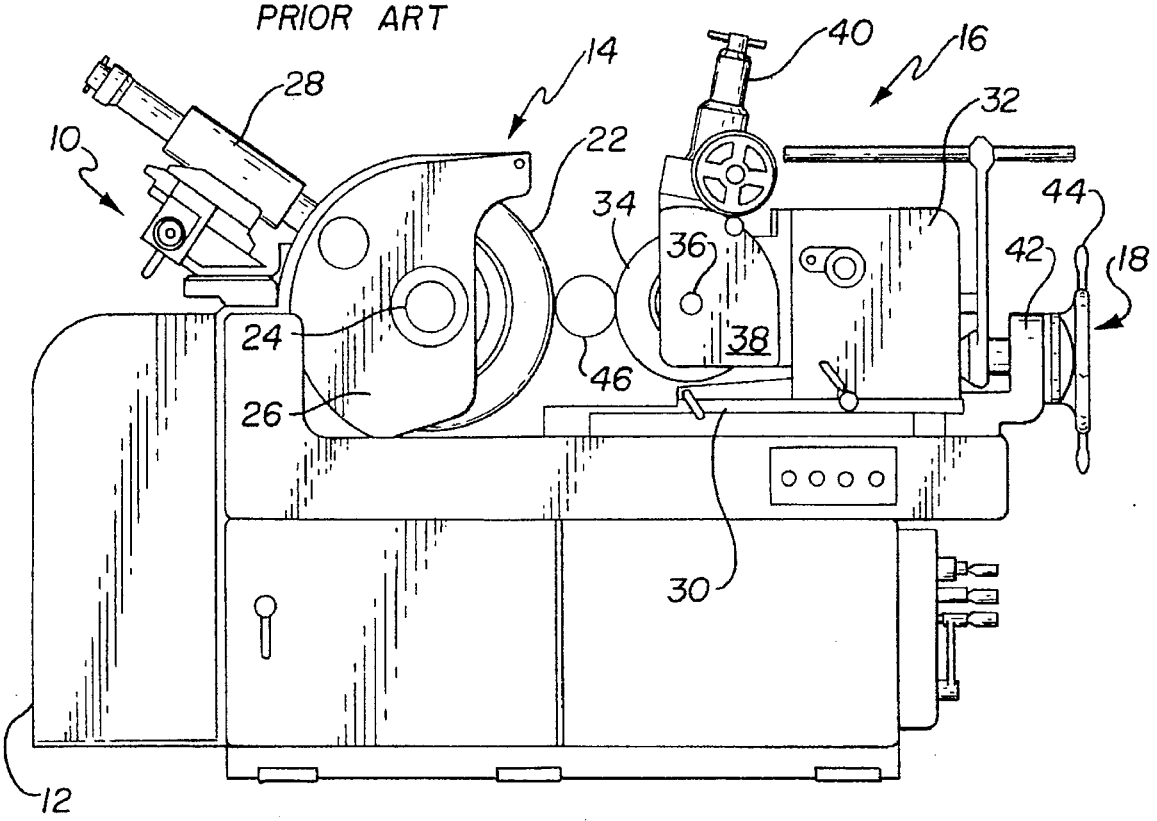
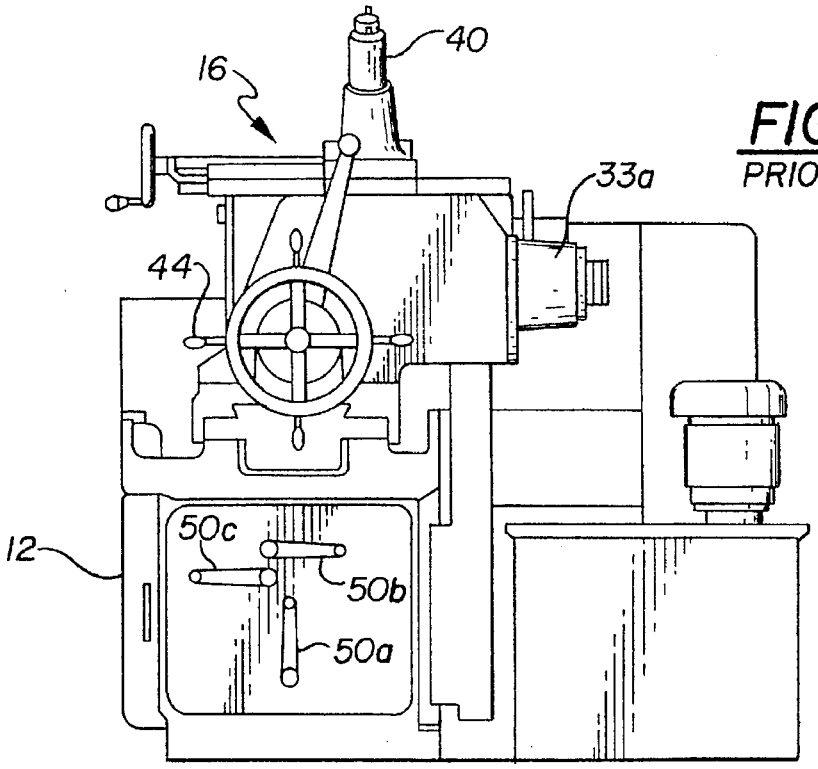
FIG-2
PRIOR ART

FIG-3
PRIOR ART
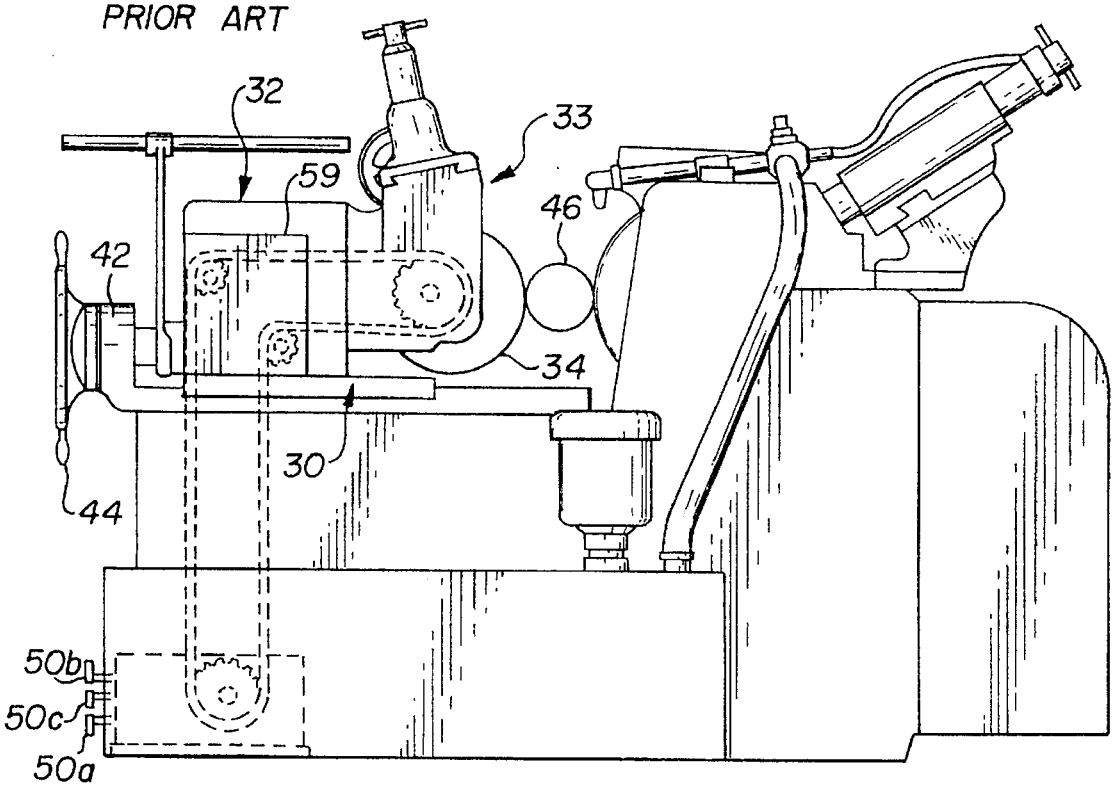
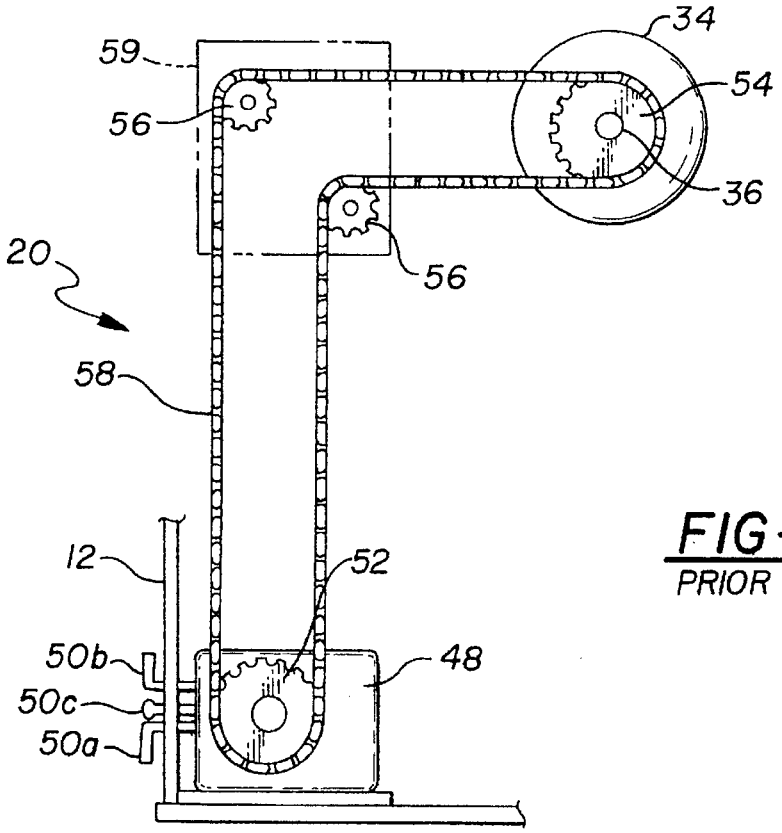
FIG-4
PRIOR ART

RETROFIT KIT FOR DRIVING THE REGULATING WHEEL OF A CENTERLESS GRINDER

BACKGROUND OF THE INVENTION

This invention relates to a centerless grinding machine and more particularly to a retrofit kit for replacing the drive mechanism for the regulating wheel of the grinder.

Centerless grinders are widely used in the machine tool industry in the manufacture of cylindrical industrial parts. The grinders are typically utilized to provide a smooth finish or precise dimensions to the cylindrical parts. The cylindrical part, or workpiece, being ground is rotated in a direction counter to that of the grinding wheel while being ground to achieve a uniform finish without excessive heat generation.

Centerless grinders typically include a grinding wheel and a regulating wheel adjacent to and facing each other in a predefined grinding area. The regulating wheel serves to rotate the part being finished or ground, and the grinding wheel performs the grinding and finishing operation. The regulating wheel contacts the workpiece and rotates it in a direction opposite to that of the grinding wheel, usually at a much slower speed.

The drive for the regulating wheel typically includes a large constant speed electric motor coupled to a mechanical select gear transmission. The transmission is a complex apparatus containing a plurality of gears, shafts, chains, and sprockets and is typically equipped with a clutch and one or more operator levers to manually shift the transmission between its various speed ratios.

Back driving of the regulating wheel, and thereby the transmission, often occurs during the operation of the grinder due to the mechanical driving connection between the grinding wheel, the workpiece, and the regulating wheel. This back driving has the effect of generating excessive wear in the transmission with the result that the transmission typically must be rebuilt or replaced several times during the useful life of the grinder. Such repairs are expensive and time consuming and result in a significant reduction in the overall efficiency of the manufacturing operation.

SUMMARY OF THE INVENTION

This invention is directed to the provision of an improved drive for the regulating wheel of a centerless grinder.

More specifically, this invention is directed to the provision of a retrofit kit for the regulating wheel drive of a centerless grinder.

This invention relates to a centerless grinder of the type including a support structure, a grinding wheel mounted on the support structure and operative to perform a grinding operation on a workpiece, a regulating wheel adjacent to and facing the grinding wheel and operative to contact the workpiece and rotate it in a direction opposite to that of the grinding wheel, drive means for the grinding wheel, and drive means for the regulating wheel. This invention relates to an improved drive means for the regulating wheel.

According to the invention, the drive means for the regulating wheel comprises an electric motor; a drive controller for the electric motor operative to control the output speed of the motor in small precise increments; a speed reducer driven by the electric motor; and means driven by the speed reducer and operative to drive the regulating wheel. This arrangement provides a simple and inexpensive, and yet extremely effective, drive for the regulating wheel.

According to a further feature of the invention, the speed reducer comprises a cycloidal speed reducer. A cycloidal speed reducer has been found to be extremely effective as a primary component of the drive of the regulating wheel of a centerless grinder. Specifically, the cycloid speed reducer provides full torque over essentially the entire operating speed range of the grinder, and since it is extremely tolerant to the back driving which typically occurs in a centerless grinder, provides a drive for the regulating wheel that requires significantly less maintenance and is significantly more durable than the complex transmission drives of the prior art regulating wheel drive systems.

According to a further feature of the invention, the regulating wheel is mounted on a spindle; the speed reducer includes an output shaft; and the means driven by the speed reducer includes a first sprocket mounted on the speed reducer output shaft, a second sprocket mounted on the regulating wheel spindle, and an endless member trained around the first and second sprockets. This simple, straightforward driving arrangement provides an effective means of transmitting power from the electric motor to the regulating wheel and facilitates the retrofitting of the invention regulating wheel drive to existing grinders.

In the disclosed embodiment of the invention, the second sprocket has a larger diameter than the first sprocket, so as to provide a further speed reduction as between the speed reducer output shaft and the regulating wheel spindle, and the endless member comprises a toothed belt, whereby to minimize slack and stretching in the system and maintain the precise operation of the system.

The invention further provides a retrofit kit for the regulating wheel drive means of a centerless grinder of the type including a base, a grinding wheel mounted on the base and operative to perform a grinding operation on a workpiece, a slide mounted on the base and including a housing defining an interior space, a spindle mounted on the slide, a regulating wheel mounted on the spindle in a position adjacent to and facing the grinding wheel and operative to contact the workpiece and rotate it in a direction opposite to that of the grinding wheel, and drive means for the regulating wheel.

According to the invention, the retrofit kit includes a gear motor comprising an electric motor and a speed reducer driven by the electric motor and having an output shaft; a first sprocket adapted to be mounted on the output shaft of the speed reducer; a second sprocket adapted to be mounted on the spindle; an endless member adapted to be trained around the first and second sprockets; a mounting bracket assembly operative to mount the gear motor on the slide housing with the electric motor positioned exteriorally of the housing and the speed reducer extending through an opening in the housing into the interior space of the housing to position the first sprocket within the interior space of the housing so as to allow the endless member to be trained around the first and second sprockets within the interior space of the housing to drive the regulator wheel in response to energization of the electric motor; and a drive controller for connection to the electric motor and operative to control the output speed of the motor in small precise increments whereby to selectively drive the regulator wheel spindle at a multiplicity of drive speeds as determined by the output speed of the motor (as established by the setting of the controller), the speed reduction ratio of the speed reducer, and the relative diameters of the first and second sprockets. This retrofit kit is readily and inexpensively retrofitted to existing grinders and, when so fitted, provides an extremely effective and durable drive for the regulating wheel.

According to a further feature of the invention, the motor of the retrofit kit is an AC motor and the drive controller comprises an AC variable speed digital controller. This specific drive arrangement provides precise and effective control of the regulating wheel over the entire operating speed range of the wheel.

According to a further feature of the invention, the speed reducer of the kit is a cycloidal speed reducer. The cycloidal speed reducer transfers power between the electric motor and the spindle of the regulating wheel, provides full torque to the wheel over the entire operating range of the wheel, and provides a drive system that is extremely tolerant of the back driving that occurs through the regulating wheel from the grinding wheel.

According to a further feature of the invention, the mounting bracket assembly of the retrofit kit comprises a mounting plate defining a central opening and identical circular seats on opposite sides of the plate in surrounding relation to the central opening and coacting with the central opening to define a radially inwardly extending circular flange between the seats; a pair of circular clamp plates sized to seat in the respective circular seats of the mounting plates on opposite sides of the flange and each defining an eccentric circular opening sized to receive the gear motor; and fastener means for fastening the clamp plates against the opposite sides of the flange and clamping the gear motor to the clamp plates whereby the central drive axis of the gear motor may be selectively varied by selectively loosening the fastener means and rotating the clamp plates in the circular seats. This arrangement allows the retrofit kit to be readily installed and precisely adjusted to provide the proper amount of slack and tolerances in the system.

The invention further provides a method of retrofitting the regulator wheel drive of a centerless grinder wherein the existing drive includes a multi-speed select gear transmission, a sprocket on the output of the transmission, an electric motor driving the transmission, and an endless member trained around the sprocket on the transmission and a sprocket on the regulating wheel spindle so that the regulating wheel is driven at a speed determined by the gear selected for the transmission.

According to the invention methodology, a gear motor is mounted on the frame structure of the grinder having an output shaft rotatable about an axis parallel to but spaced from the axis of the regulating wheel spindle; the endless member is removed from the sprocket on the spindle; a sprocket is mounted on the output shaft of the gear motor; and a replacement endless member is trained around a sprocket on the spindle and the sprocket on the output shaft of the gear motor. This methodology allows ready and inexpensive retrofitting of the regulating wheel drive system to provide an extremely effective and durable drive for the regulating wheel. In the disclosed embodiment of the invention methodology, the spindle sprocket forming a part of the original retaining wheel drive system is removed and replaced with a new sprocket and the endless member is trained around the new spindle sprocket and the sprocket on the output shaft of the gear motor.

According to a further feature of the invention methodology, the gear motor comprises an electric motor and a cycloidal speed reducer driven by the electric motor. The use of the cycloidal speed reducer in the regulating wheel drive provides excellent torque transmission and minimizes wear in the regulating wheel drive system.

According to a further feature of the invention methodology, the grinder support structure includes an exterior housing wall defining an access opening covered by an access plate, and the method includes the further steps of removing the access plate and mounting the gear motor on the housing proximate the access opening with the sprocket on the speed reducer output shaft positioned within the housing.

According to a further feature of the invention, the step of mounting the gear motor on the housing proximate the access opening comprises positioning the electric motor exteriorally of the housing with the speed reducer extending into the interior of the housing through the access opening to position the sprocket on the output shaft of the speed reducer within the housing.

BRIEF DESCRIPTION OF THE DRAWINGS

FIGS. 1, 2, and 3 are front, end, and rear views respectively of a centerless grinder employing a retaining wheel drive according to the prior art;

FIG. 4 is a schematic view of the prior art regulating wheel drive;

DETAILED DESCRIPTION OF THE PREFERRED EMBODIMENT

Figure 5:
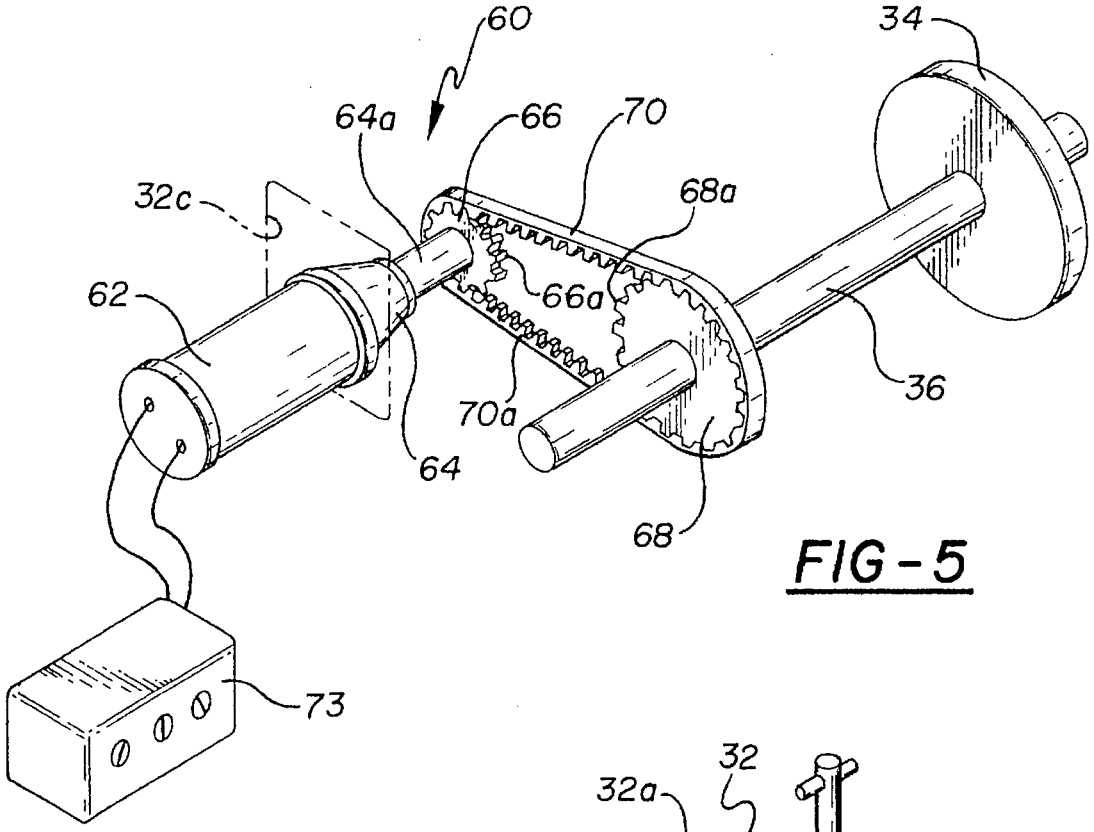
FIG. 5 is a schematic view of a regulating wheel drive according to the invention.
Figure 6:
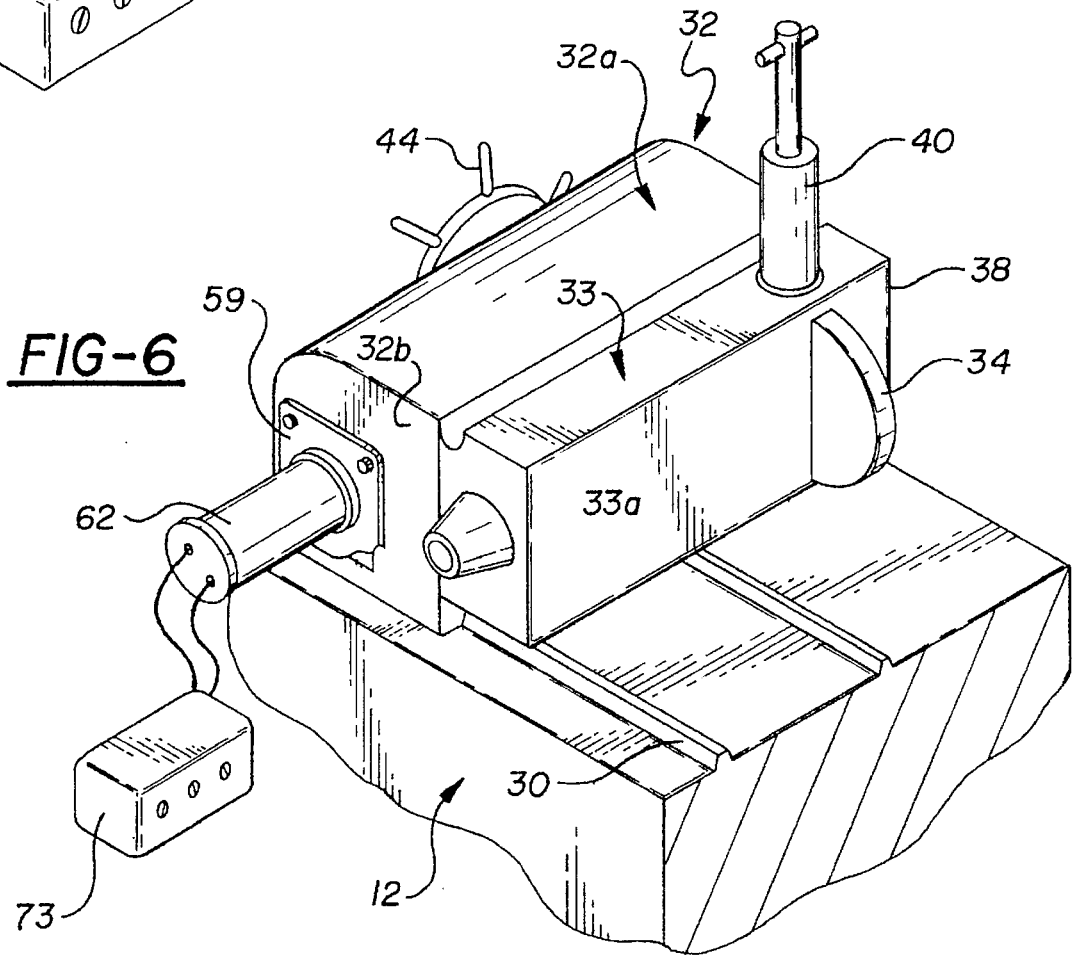
FIG. 6 is a perspective fragmentary view showing the installation of the invention regulating wheel drive on the centerless grinder.

FIGS. 1–4 illustrate a typical prior art centerless grinding machine 10.

Grinding machine 10 includes a base 12, a grinding wheel assembly 14, a regulating wheel assembly 16, a pilot wheel assembly 18, and a regulating wheel drive 20.

Grinding wheel assembly 14 includes a grinding wheel 22 mounted on base 12, a grinding wheel spindle 24, a grinding wheel protective cover 26, and a grinding wheel dresser 28. The grinding wheel dresser 28 is used to dress the grinding wheel in known manner. Grinding wheel 22 is driven by a grinding wheel drive (not shown) at a generally constant, relatively high speed.

Regulating wheel assembly 16 includes guide tracks 30 mounted on the base 12, a slide 32 mounted on the tracks 30 for movement toward and away from the grinding wheel assembly, a regulating wheel housing 33 mounted on the slide 32, a regulating wheel 34 carried by the regulating wheel housing, a regulating wheel spindle 36, a regulating wheel shield 38, and a regulating wheel dresser 40. Dresser 40 is used in known manner to dress the regulating wheel.

Regulating wheel housing 33 rotatably mounts spindle 36 and provides suitable bearing supports for the spindle including an end housing **33*a*** mounting a thrust bearing receiving an end of the spindle.

Pilot wheel assembly 18 includes a bracket 42 mounted on base 12, a pilot wheel 44 mounted on bracket 44 and including a screw (not shown) coacting with the slide 32 to move the slide back and forth on the tracks 30 in response to rotation of pilot wheel 44 whereby to selectively vary the distance between the regulating wheel 34 and grinding wheel 22 to accommodate workpieces 46 of varying sizes.

With particular reference to FIGS. 2 and 4, regulating wheel drive 20 includes a multi-speed select gear transmission 48 positioned in base 12 and including a plurality of shift levers 50*a*, 50*b*, and 50*c* operative when moved to selected combined positions to selectively determine the gear ratio provided by the transmission; an electric motor (not shown) positioned in base 12 and driving the transmission through a suitable clutch mechanism (not shown); a transmission sprocket 52 mounted on the output shaft of the transmission; a regulating wheel spindle sprocket 54 mounted on spindle 36; spring biased idler sprockets 56; and an endless chain 58 trained around sprockets 52, 54, and 56 in the manner seen in FIG. 4 so that the regulating wheel is driven at all times at a speed determined by the gear selected by the transmission 48 in response to operator positioning of the gear shift levers 50*a*, 50*b*, and 50*c*. For example, each lever 50*a*, 50*b*, and 50*c* may have three positions which may, in combination, provide 12 transmission output speeds and thereby 12 regulating wheel speeds.

Slide 32 comprises a generally hollow housing 32*a* including a housing side wall 32*b*. A generally rectangular access or cover plate 59 is mounted on housing side wall 32*b* in overlying relation to a generally rectangular access opening 32*c* in housing side wall 32*b*. Access opening 32*c* provides access to idler sprockets 56 for maintenance and repair purposes.

Whereas the described prior art regulating wheel drive is generally satisfactory, it suffers from the disadvantages that the torque transmitted by the drive system varies significantly over the operating range of the system and by the further disadvantage that the drive system, and in particular the transmission, requires frequent and major repair and replacement. The excessive wear in the transmission is caused by the complexity of the transmission and by the fact that in many operating modes of the grinder, the grinding wheel effectively back drives the regulating wheel drive through the workpiece and the prior art regulating wheel drive system, and in particular the select gear transmission, does not tolerate this back driving well and in fact wears excessively and rapidly in response to this back driving.

The invention concerns a regulating wheel drive retrofit kit 60 which may be easily installed in place of the prior art regulating wheel drive seen in FIG. 4 and which provides superior performance to the prior art drive system and significantly lower maintenance and repair costs.

As best seen in FIG. 5, the invention retrofit kit 60 includes an electric motor 62, a cycloidal gear reducer 64, a cycloidal gear reducer sprocket 66, a regulating wheel spindle sprocket 68, a toothed belt 70, a mounting bracket assembly 72 (FIG. 8), and a controller 73.

Electric motor 62 may comprise, for example, a 2-horsepower, 240 volts AC unit.

Figure 11:
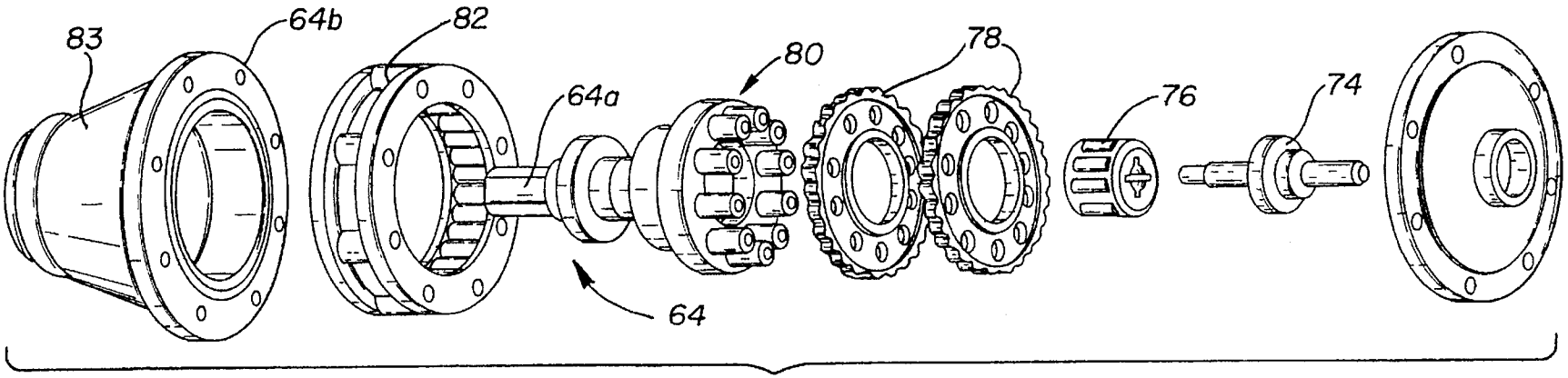
FIG. 11 is an exploded view of the cycloidal speed reducer.
Figure 12:
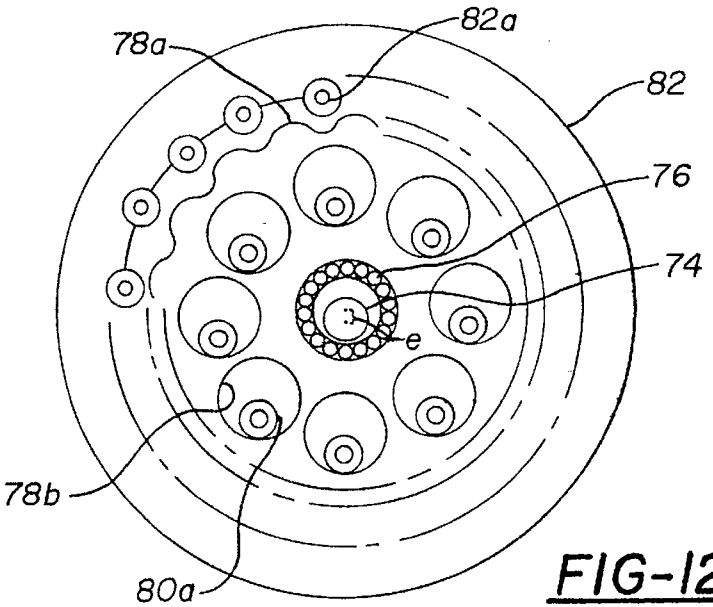
FIG. 12 is a somewhat schematic view of the cycloidal speed reducer.
Figure 10:
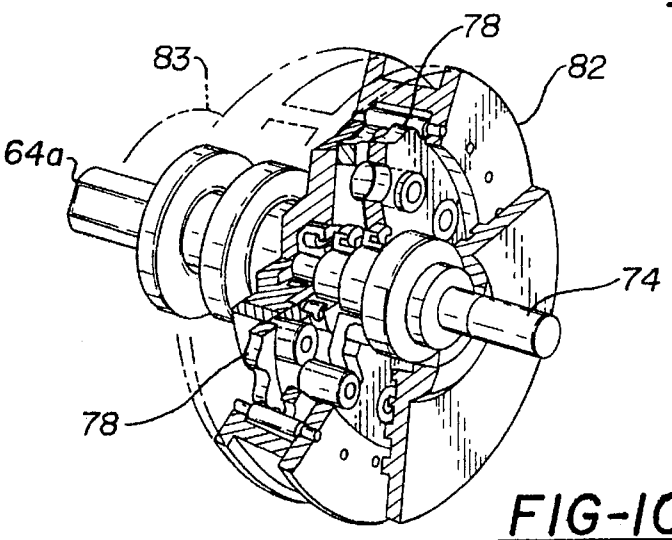
FIG. 10 is a fragmentary perspective view of a cycloidal speed reducer utilized in the invention regulating wheel drive.

Cycloidal speed reducer 64 is of known form and may provide, for example, an 11:1 speed reduction as between the input and output shafts of the speed reducer. As seen in FIGS. 10, 11, and 12, speed reducer 64 includes three major moving parts: specifically, a high speed input shaft 74 with an integrally mounted eccentric cam and roller assembly 76, a pair of cycloid disks 78, and a slow speed shaft assembly 80. As eccentric high speed input shaft 74 rotates, it rolls the cycloid disks 78 around the internal circumference of a stationary ring gear 82 carried by the speed reducer housing 83. The resulting action is similar to that of a wheel rolling along the inside of a ring. As the cycloid disks travel in a clockwise path around the inside of the ring gear, the cycloid disks turn in a counterclockwise direction around their own axis. The teeth 78*a* of the cycloid disks engage successively with the pins 82*a* of the ring gear 82, thus providing a reverse rotation at a reduced speed. For each complete revolution of the high speed shaft 74, the cycloid disks 78 are advanced the distance of one tooth in the reverse direction. In general, there is one less tooth per cycloid disk than there are pins in the fixed ring gear which results in the reduction ratio being equal to the number of teeth in each disk. The movement of the cycloid disks is transmitted to the slow speed shaft by the projection of the pins 82*a* of the slow speed shaft assembly through bores 78*b* provided in the cycloid disks in concentric relation with the center of the disks. A two cycloid disk system is used to increase torque capacities and provide vibrationless drive. The pins 82*a* and 80*a* have a circular cross-sectional configuration and the gear teeth 78*a* have an epitrochoid configuration. The diameter of bores 78*b* minus the diameter of pins 80*a* is equal to twice the eccentricity value e of the high speed shaft 74 with respect to the eccentric cam and roller assembly 76. The cycloidal speed reducer may be provided as a separate unit for use with a separate electric motor 62 (for example, a cycloidal speed reducer unit available from Sumatomo Machinery Corporation of America as part No. VF3105HS56C11.1) or may be provided as a part of a gear motor comprising an electric motor 62 in combination with a speed reducer 64 (for example, a gear motor available from Sumatomo Machinery Corporation of America as part No. HFM310HC12115UM).

Referring to FIG. 5, speed reducer sprocket 66 is configured to be splined to the output shaft 64*a* of the speed reducer and has teeth 66*a* configured to accommodate toothed belt 70.

Regulating wheel spindle sprocket 68 is adapted to be pinned or otherwise fixedly secured to regulating wheel spindle 36 and includes teeth 68*a* configured to accommodate toothed belt 70. Sprocket 68 is larger than sprocket 66 and may, for example, have a diameter ratio with respect to sprocket 66 of 1.875:1, thereby providing a further speed reduction as between speed reducer output shaft 64*a* and spindle 36.

Toothed belt 70 includes cogs or teeth 70*a* sized to be accommodated by the teeth 66*a* and 68*a* on the sprocket 66 and 68 thereby to provide a smooth non-stretchable drive between the two sprockets. Sprockets 66 and 68 may, for example, be of the type available from Gates Rubber Co. of Denver, Colo. as part Nos. 8M-345-36 and 8M-605-36 respectively and belt 70 may be of the type available from Gates Rubber as part No. 8M-1280-36.

Figure 7:
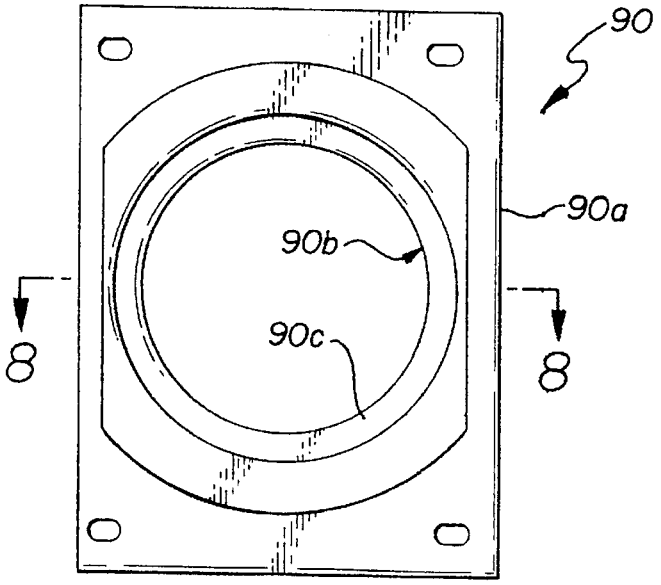
FIGS. 7, 8, and 9 are detail views of a mounting plate assembly used to install the invention regulating wheel drive on the grinder.
Figure 9:
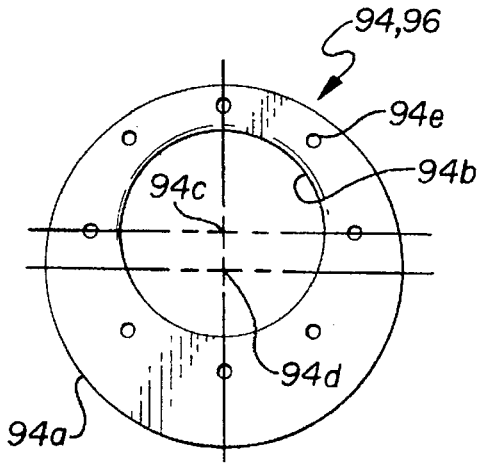
Figure 8:
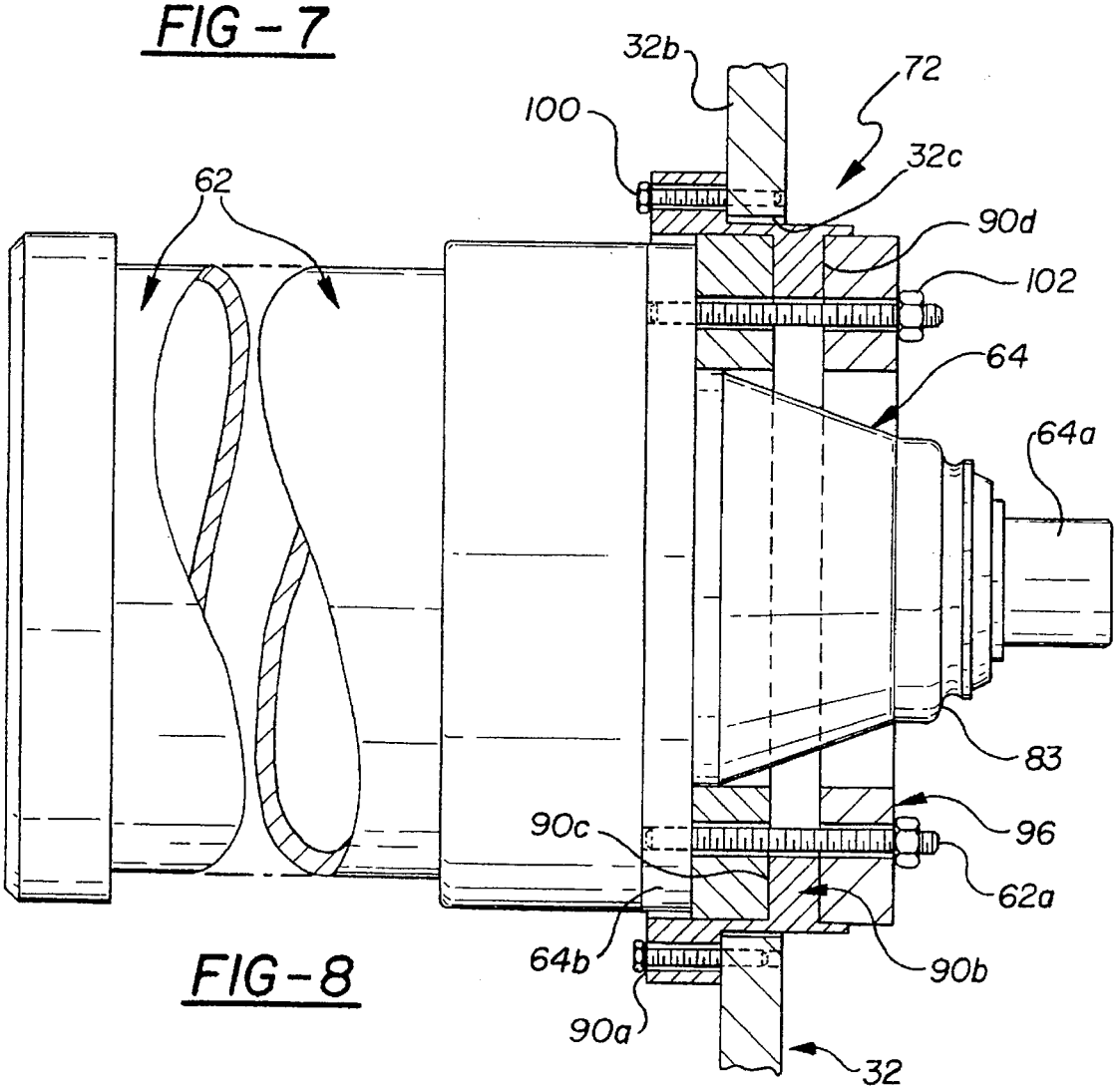

Referring to FIGS. 7, 8, and 9, mounting bracket assembly 72 includes a mounting plate 90 and a pair of identical adapter plates 94 and 96.

Mounting plate 90 has a generally rectangular configuration and is machined to provide an external generally rectangular flange 90*a* and an internal circular flange 90*b*. The opposite annular sides of internal flange 90*b* respectively define an external circular seat 90*c* and an internal circular seat 90*d*.

Adapter plates 94/96 are identical (only plate 94 will be described) and include a circular outer periphery 94*a* and an eccentric circular hole 94*b* having a center 94*c* that is offset or eccentric with respect to the center 94*d* of the exterior periphery 94*a*. Plate 94 further includes a series of holes 94*e* lying on a bolt circle centered on the center 94*c*. The outer periphery 94*a* of plate 94 is sized to fit snugly within seat 90*c* (and plate 96 is similarly sized to fit snugly within seat 90*d*).

Controller 73 is a variable frequency drive digital controller and has the capacity, for example, to increase the speed of motor 62 in one rpm increments over a motor speed range of 10 to 5,400 rpms. Controller 73 may, for example, be of the type available from Asea Brown Boveri of New Berlin, Wis. as part No. 8CS201-2P7-1-OOPIO.

To retrofit the invention regulating wheel drive 60 in place of the prior art regulating wheel drive 20, access cover 59 is removed, chain 58 is released from idler sprockets 56 and spindle sprocket 54 and is either removed or allowed to drop to the bottom of the base housing; idler sprockets 56 and their associated spring biasing mechanisms are removed; spindle 36 is moved axially to allow regulating wheel spindle sprocket 54 to be removed; regulating wheel spindle sprocket 68 is installed on spindle 36 in place of the removed sprocket 54 and the spindle is axially returned to its operative position; speed reducer sprocket 66 is mounted on speed reducer output shaft 64*a*; mounting plate 90 is positioned in access opening 32*c* (utilizing fasteners 100 engaging the threaded apertures in the slide housing side wall 32*b* previously engaged by the fasteners for the cover plate 59) with external flange 90*a* positioned exteriorally of the slide housing in surrounding relation to opening 32*c* and with internal flange 90*b* positioned within opening 32*c*; plates 94, 96 are positioned in seats 90*c* and 90*d*, respectively, with their eccentricities aligned; mounting flange 64*b* of speed reducer 64 is positioned against adapter plate 94; studs 62*a* provided on the mounting flange of motor 62 are passed through bolt holes in speed reducer flange 64*b*, through bolt circle holes 94*e*, through mounting plate central aperture 90*b*, and through bolt circle holes 96*e* for engagement by nuts 102 which are tightened to clamp adapter plates 94 and 96 against the opposite faces of flange 90*b* and clamp the motor and speed reducer to the adapter plate 94; belt 70 is trained around sprockets 66 and 68; adapter plates 94 and 96 are rotated in their circular seats on the mounting plate to selectively move the central drive axis of the motor and speed reducer to selectively adjust the tension in belt 70; and controller 73 is hard wired to motor 62 and is positioned at a location on the grinding machine, or in the vicinity of the grinding machine, at the discretion of the user. The retrofitted regulating wheel drive kit is now ready for use.

It will be seen that drive kit 60 is retrofitted as a replacement for original drive 20 with a minimum of time and effort and requiring a minimum of skill. Further, the system once installed provides superior drive characteristics as compared to the replaced system 20. Specifically, by virtue of the superior and unique drive characteristics of the cycloidal speed reducer, the new drive system is able to provide full torque to the regulating wheel over the entire operating range of the regulating wheel and the new drive system is able to tolerate the back driving from the grinding wheel through the regulating wheel that has plagued the transmissions of the prior art drive system and, specifically, is able to function without maintenance for machine usage times far in excess of the usage times provided between maintenance requirements on the prior art regulating wheel drive system. Further, by virtue of the simplicity of the replacement drive system and the ease with which the system is retrofitted to the grinder, the replacement drive system may be provided at a fraction of the cost of replacing and replicating the prior art drive system. Further, because of the virtually unlimited motor speeds, and thereby regulating wheel speeds, provided by the digital controller, as compared to the relatively small number of widely gated regulating wheel speeds provided by the select gear transmission of the prior art, the invention drive system is able to provide much more precise control of the regulating wheel speed whereby to provide much more precise control of the grinding operation being performed by the grinding wheel.

Whereas a preferred embodiment of the invention has been illustrated and described in detail, it will be apparent that various changes may be made in the disclosed embodiment without departing from the scope or spirit of the invention.

I claim:

1. For use with a centerless grinder comprising a base, a grinding wheel mounted on the base and operative to perform a grinding operation on a workpiece, a slide mounted on the base and including a housing defining an interior space, a regulating wheel housing carried by the slide, a spindle mounted on the regulating wheel housing, a regulating wheel mounted on the spindle in a position adjacent to and facing the grinding wheel and operative to contact the workpiece and rotate it in a direction opposite to that of the grinding wheel, and drive means for the regulating wheel, a retrofit kit for the regulator wheel drive means comprising:

a gear motor comprising an electric motor and a speed reducer driven by the electric motor and having an output shaft;

a first sprocket for mounting on the output shaft of the speed reducer;

a second sprocket for mounting on the spindle;

an endless member for training around the first and second sprockets;

a mounting bracket assembly operative to mount the gear motor on the slide housing with the electric motor positioned exteriorally of the slide housing and the speed reducer extending through an opening in the slide housing into the interior space of the slide housing to position the first sprocket within the interior space of the slide housing so as to allow the endless member to be trained around the first and second sprockets within the interior space of the slide housing to drive the regulator wheel in response to energization of the electric motor; and a drive controller for connection to the electric motor and operative to control the output speed of the motor in small increments whereby to selectively drive the regulator wheel spindle at a multiplicity of drive speeds as determined by the setting of the controller, the speed reduction ratio of the speed reducer, and the relative diameters of the first and second sprockets.

2. A retrofit kit according to claim 1 wherein:

the motor is an AC motor; and the drive controller comprises an AC variable speed digital controller.

3. A retrofit kit according to claim 1 wherein the speed reducer is a cycloidal speed reducer.

4. A retrofit kit according to claim 3 wherein the endless member comprises a toothed belt.

5. A retrofit kit according to claim 1 wherein the mounting bracket assembly comprises:

a mounting plate defining a central opening and identical circular seats on opposite sides of the plate in surrounding relation to the central opening and coacting with the central opening to define a radially inwardly extending circular flange between the seats;

a pair of circular clamp plates sized to seat in the respective circular seats of the mounting plate on opposite sides of the flange and each defining an eccentric circular opening sized to receive the gear motor; and fastener means for clamping the clamp plates against the opposite sides of the flange and clamping the gear motor to the clamp plates whereby the central drive axis of the gear motor may be selectively varied by selectively loosening the fastener means and rotating the clamp plates in the circular seats.

6. A retrofit kit according to claim 5 wherein the fastener means comprise studs on a flange structure defined by the gear motor.

7. A retrofit kit according to claim 6 wherein the mounting plate further includes outboard apertures to facilitate attachment of the mounting plate and thereby the gear motor to the housing.

* * * * *